United States Patent [19]

Hale

[11] 4,171,674

[45] Oct. 23, 1979

[54] FAIRING FOR PIPES

[76] Inventor: Neville E. Hale, 2132 Springbank Rd., Mississauga, Ontario, Canada

[21] Appl. No.: 840,393

[22] Filed: Oct. 7, 1977

[30] Foreign Application Priority Data

Oct. 8, 1976 [CA] Canada ..... 263003

[51] Int. Cl.[2] ..... B63B 21/00

[52] U.S. Cl. ..... 114/243

[58] Field of Search ..... 114/243, 244, 16 B, 114/16 C, 339, 340; 61/54, 102; 166/0.5, 352; 175/7; 340/3 T; 405/211, 216

[56] References Cited

U.S. PATENT DOCUMENTS

| | | | |
|---|---|---|---|
| 1,104,254 | 7/1914 | Reimers | 114/243 |
| 3,194,204 | 7/1965 | Nichols et al. | 114/243 |

FOREIGN PATENT DOCUMENTS

| | | | |
|---|---|---|---|
| 2250353 | 5/1975 | France | 114/243 |
| 483299 | 12/1975 | U.S.S.R. | 114/243 |

*Primary Examiner*—Charles E. Frankfort
*Attorney, Agent, or Firm*—Donald E. Hewson

[57] ABSTRACT

A fairing for pipes or other substantially rigid structures is disclosed, where the pipe may be immersed in a fluid medium, usually fresh water or sea water. The fairing is formed as a shell having a nose portion in which the pipe—or a pipe bundle—is accommodated and a tail portion; and at least the tail portion of the fairing has a plurality of upstanding ribs which extend at least from the forward portion of the tail to the rear portion thereof. The cross-sections taken through the upstanding ribs are different in absolute terms than the cross-sections taken through the alternating tail portions between the ribs; but the aspect ratios of length to breadth of each of the cross-sections are similar. A pair of stabilizer plates may be secured across the outer surfaces of the upstanding rib portions near the rearward ends thereof; and apertures may be formed in trailing fin portions which extend rearwardly from behind the alternating tail portions, with at least a portion of each of the apertures being between the stabilizer plates. In general, the aspect ratios through the tail portion and the rib portion, respectively, of a fairing such as may be used on riser pipes for such as an offshore well may be approximately 2:1 and 2.1:1.

26 Claims, 12 Drawing Figures

FAIRING FOR PIPES

FIELD OF THE INVENTION

This invention relates to fairings of the sort used for reducing the coefficient of drag on a pipe or other structural component due to relative movement of that pipe or other structural component with respect to the fluid medium in which it is immersed. In particular, the present invention is adapted for use with pipers—which are substantially rigid—immersed in water either for purposes of undersea mining or as riser pipes in offshore drilling rigs and the like. The fairings contemplated by this invention are, therefore, in general quite large.

BACKGROUND OF THE INVENTION

Fairings for underwater towing purposes, whereby the coefficient of drag on a towing cable is reduced, are well known. For example, Hale U.S. Pat. No. 3,611,976 issued Oct. 12, 1971 teaches an improved fairing for underwater towing cables which serves to reduce the coefficient of drag on the towing cable to less than 0.1. The fairing has a substantially rigid tail portion and a nose portion which is flexible in the forward direction so that the cable can be reeled—i.e., stowed—on a winch without damage to the fairing and without having to pre-dimension a curve in the nose of the fairing. However, such fairings have been used in diameters ranging from less than 1 cm. to 8 or 10 cm. Recently there has been some considerable interest in the use of fairings to reduce the coefficient of drag on substantially rigid pipes which may be used for such purposes as deep-sea mining of manganese nodules and the like; and as well, on riser pipes in offshore drilling rigs and similar installations.

In such instances, however, the pipe, or pipe bundle, is substantially rigid and assembled in lengths; and it is useful to provide a fairing which can be easily handled and which will accommodate very large pipes in such installations as those noted above. Accordingly, the present invention provides a fairing which basically comprises a pair of shell halves—usually formed from suitable plastics material such as acrylonitrile butadiene styrene or the—where the fairing is quite rigid itself, and comprises a nose portion adapted to accommodate the pipe and a tail portion which provides the streamlining effect. The fairings have a plurality of upstanding rib portions formed therein, at least in the tail portions thereof; and the upstanding rib portions provide a different cross-section taken therethrough than the cross-section taken through the intervening or alternating tail portions between the rib portions, at least in absolute terms of length and breadth. However, notwithstanding the differences in absolute terms of length and breadth of the cross-sections of a fairing according to this invention, taken through any upstanding rib portion and through any alternating tail portion therebetween, the aspect ratios of chord length of the cross-section at least to the rearmost termination of the tapered portion thereof to the breadth of the cross-section, of either cross-section respectively, are substantially similar. Moreover, it is a particular feature of this invention that the aspect ratios of fairings according hereto are very low, generally in the range of 1.8:1 to 4:1, and most usually 2:1 or 2.1:1.

By forming a fairing according to the present invention in two shell halves from a suitable plastics material, the fairing may be assembled by installing a hinge between the shell halves at the parting line thereof along the front of the nose portion of the fairing; and suitable detachable fasteners may be installed in the tail portion. Accordingly, a fairing can be assembled to a pipe either by unhinging the shell halves and fitting the nose portion of the fairing to the pipe, or by fitting the shell halves together and installing a hinge pin and suitable fasteners. Usually, of course, the fairing shell halves are hingably opened with respect to each other and the pipe to which the fairing is to be fitted is accommodated in the nose portion. In any event, the pipes or pipe bundles as referred to hereafter which may be accommodated by fairings contemplated by the present invention may have diameters in the range of from approximately 20 cm. to approximately 1 m. The physical size of such fairings is, therefore, quite large; and in order for the fairings to be easily handled without the necessity for special equipment, they are produced as shell halves of suitable plastic material.

The importance of low aspect ratio fairings now becomes evident, in view of the physical size being handled. For example, an ordinary fairing having an aspect ratio of approximately 5:1 and having a breadth sufficient to accommodate a pipe with a diameter of 0.5 m. would require a length from nose to trailing edge of more than 2.5 m. However, when a fairing is provided having an aspect ratio of length to breadth in the order of 2:1, the restoring forces acting on the tail of the fairing as the relative angle of attack of the fairing to the fluid medium—usually water—changes or shifts, may not be sufficient to cause the fairing to swing sufficiently quickly into position. In such circumstances, strumming or vibration of the fairing and the structure to which it is fitted may occur.

A distinction must be drawn between fairings which will accommodate a shift in direction of relative flow of the faired structure to the fluid medium as opposed to the streamlining fairing of the sort referred to in Schuh U.S. Pat. No. 3,410,096 issued Nov. 12, 1968. That patent teaches an assembly for streamlining a riser pipe of an offshore drilling rig or the like, where the assembly must be critically aligned with respect to the current. The device taught by that patent is said to accommodate a change of direction of flow of current—a change of angle of attack—of plus or minus 30° with respect to the X axis; but where the ellipse ratios become less, the permissive angle of attack may be only 20° or even 10°. The Schuh streamlined riser pipe, therefore, is such that only relatively small changes of current flow can be accommodated; but where the offshore drilling rig is installed in such a place as the mouth of a very large river but is subject to high tide flow, it is important to provide a fairing which has an accommodation of 360° of swing in either direction. Likewise, when towing a pipe for undersea mining purposes, a fairing having cocking capabilities is required.

Yet another application where very large size fairings having short aspect ratios may be required is in the matter of laying fuel pipelines across waterways, especially waterways having high current flow which differs from time-to-time or from top to bottom as the pipeline is being placed. It has been known where the drag on a pipeline produced by current flow of the waterway in which the pipeline is being laid has been sufficiently great as to pull a crane or bulldozer into the water, with the resultant loss of capital equipment as well as of the pipeline itself. Accordingly, another purpose for fairings according to the present invention may be to permit more economical laying of pipelines in waterways, with far less energy expenditure and the commensurate time and labour savings.

In all of the above circumstances, however, where a fairing is used having a short aspect ratio of length to breadth, and where it is important that the restoring force on the fairing be such as to align the fairing with flow as quickly as possible, an improved and preferred embodiment of the present invention provides a fairing having a pair of stabilizer plates secured across the outer rear portions of the ribs of the fairing, on either side thereof. What is provided is, to some extent, analogous to a slotted wing; but the fairing is symmetrical and the restoring force must be capable of operating in either direction, so that differences between the fairing and a slotted wing are substantial.

Indeed, in the preferred embodiment of fairing according to this invention, apertures are formed in trailing fin portions of the fairing which extend behind the intervening tail portions between the rib portions thereof; and which substantially underlie the stabilizer plates secured to the rib portions. These apertures appear to provide for faster restoring forces by accommodating a net flow of fluid medium—usually water—from the one side of the fairing to the other as the fairing swings to re-align itself with the relative stream flow.

When a fairing of the sort provided by this invention is installed on a pipe and immersed in water—either fresh water or sea water—and the interior of the fairing shell is permitted to flood, the fairing has substantially neutral buoyancy. Therefore, no additional bearing weight is provided by the fairing nor does any such additional weight need to be accommodated either from above if the pipe is suspended thereby or from below if the pipe has a net weight downwardly against apparatus installed at its base and on the sea floor. The provision of neutral buoyancy also means, of course, that long pipe lengths can be handled, when faired, without the necessity for special handling tools to accommodate the extra weight of the fairings; because the fairings are, even in free air, relatively quite light.

In order to accommodate pipes of varying diameters, or pipe bundles, collars may be fitted to fairings according to this invention. Such collars are secured to the pipe or pipe bundle, and the swinging motion of the fairing is then accommodated relative to the collars. Indeed, for very long or very large pipes, collars are generally installed either between each adjacent pair of fairings or at least with respect to a small group of fairings. The collars thereby serve several purposes, including the provision of facing surfaces to accommodate the swinging motion of the fairing on the pipe, and the accommodation of different sized pipes in a given fairing or more than one pipe such as a main riser pipe and a choke line, hose bundle and the like. Thus, it may be possible to permit movement of a small-bore exploratory drilling ship from one site to another without recovering and dis-assembling the faired drill casing.

BRIEF SUMMARY OF THE INVENTION

The major purpose of this invention is to provide a fairing for pipes and other substantially rigid structure which may be dimensionally quite large, where the fairing has a relatively low aspect ratio of length to breadth, and is sufficiently light but sufficiently strong as to be easily handled and assembled to the pipe.

A further object of this invention is to provide a fairing for pipes and the like, where the fairing has excellent cocking capabilities notwithstanding a low aspect ratio of length to breadth.

Yet another object of this invention is to provide an improved fairing for pipes and the like where the fairing has two different cross-sections taken through rib portions thereof and the intervening tail portions, where the aspect ratio of each of the cross-sections is quite low, and where stabilizer plates are provided near the trailing edge of the fairing at each side thereof and are secured to the rearward portions of the ribs.

A feature of the present invention is that fairings contemplated hereby may be easily and relatively inexpensively produced from suitable plastic materials, may be easily assembled and handled without the necessity for special material handling apparatus.

BRIEF DESCRIPTION OF THE DRAWINGS

These and other objects and features of the invention, in its several embodiments are discussed in greater detail hereafter in association with the accompanying drawings, in which.

DESCRIPTION OF THE PREFERRED EMBODIMENTS

Figure 1:
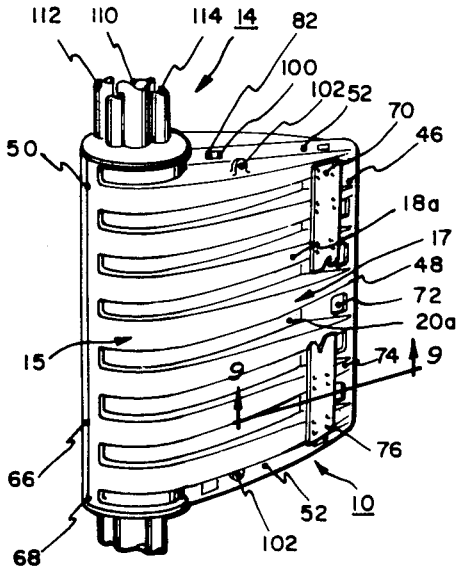
FIG. 1 is a perspective view of a preferred embodiment of a fairing according to this invention.

As noted above, this invention provides a fairing for pipes and other substantially rigid structures which are immersed in a fluid medium, where the fairing reduces the coefficient of drag on the pipe or other substantially rigid structure which may occur due to the relative flow of the fluid medium with respect to the pipe. This, the pipe may be moving through the fluid medium, or the fluid medium may be moving passed the pipe or both. In general, the fluid medium is water, either fresh water or sea water; but the fluid medium may, in certain circumstances, be air or other gases or liquids.

Two somewhat different practical embodiments of fairings, according to this invention are shown in the drawings and described in detail hereafter. The following description also discusses various alternative features and arrangements with respect to fairings according to this invention which may be provided or accommodated, and are as contemplated herein.

Figure 2:
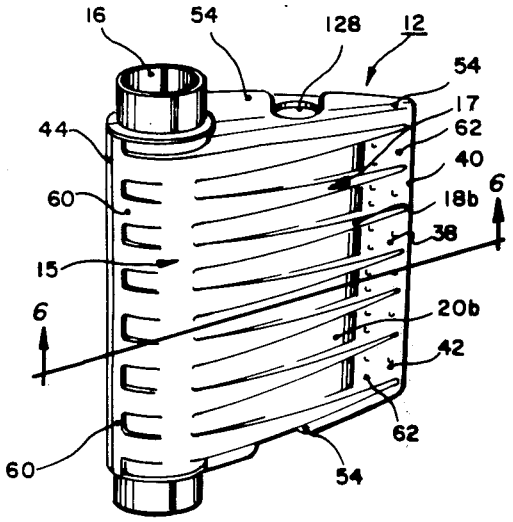
FIG. 2 is a perspective view of a second embodiment of a fairing according to this invention.

Thus, the drawings show a first general embodiment 10 in FIG. 1 of a fairing contemplated by this invention; and a second general embodiment 12 in FIG. 2, which differs somewhat from the embodiment of fairing 10 in FIG. 1.

It will be noted that, for purposes of this discussion, the fairing 10 is shown to accommodate a pipe bundle 14 in its nose portion, whereas the fairing 12 of FIG. 2, accommodates a single pipe 16 in its nose portion.

The nose portion of each of fairings 10 and 12 is indicated generally by the reference numeral 15, and the tail portion of each fairing is generally indicated by the reference numeral 17.

Thus, each of the fairings 10 and 12 comprises a shell—as will be more clearly described hereafter—of a substantially rigid material which forms a symmetrical structure, each having a nose portion 15 and a tail portion 17. The nose portion 15 of each fairing has an opening along its axis to accommodate a pipe or pipe bundle such as the pipe bundle 14 or pipe 16; and at least in the tail portion 17 of each fairing there is a plurality of upstanding rib portions 18*a* in fairing 10 and 18*b* in fairing 12, and the rib portions 18*a* or 18*b* are spaced axially along each side of each fairing 10 or 12 and extending rearwardly from the front of the respective fairing; and a plurality of intervening or alternating tail portions 20*a* or 20*b* between the upstanding rib portions 18*a* or 18*b* respectively.

Figure 5:
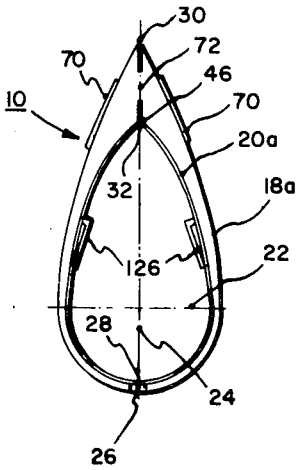

Aspect ratios, which are the ratio of length to breadth of the fairing, and which are taken at a cross-section through any of the upstanding rib portions 18*a* or 18*b* are similar to aspect ratios taken through any of the alternating tail portions 20*a* or 20*b*. As noted, the aspect ratio is the ratio of length to breadth of the fairing, and the breadth is the greatest width of each respective cross-section being referred to, and the length is the chord length taken along the front-to-rear axis of the fairing from the front thereof to the rearmost point of the cross-section where a rearward taper thereof terminates. Thus, referring specifically to FIGS. 5 and 6, cross-sections of fairings 10 and 12 are shown, each taken through an alternating tail portion thereof as shown in FIGS. 1 and 2 respectively. Referring to FIG. 5, the outlines of the upstanding rib portions 18*a* and the intervening or alternating tail portions 20*a* are shown. The aspect ratio of length to breadth is determined with measurements of the breadth of each of the cross-sections of the rib portions 18*a* and the intervening tail portions 20*a* at the greatest width thereof—in this case, on the cross-axis 22; and the length of each respective cross-section is taken along the chord length from the front of the cross-section to the rearmost point of the cross-section where a rearward taper thereof terminates—and in this case, the measurement is made along the front-to-back axis 24. Thus, the chord length of the cross-section of rib portions 18*a* is taken from the point 26 to the point 30, and the cross-section of the intervening tail portions 20*a* is taken from the point 28 to the point 32. In like manner, the width of cross-section of the fairing 12 is taken on cross-axis 23 and the length is measured along front-to-back axis 25; where the chord length of the rib portions 18*b* is measured from point 34 to point 36, and the chord length of the alternating tail portions 20*b* is measured from point 34 to point 39. It will be seen from FIGS. 5 and 6 that the length and breadth respectively of any cross-section taken through any of the upstanding rib portions 18*a* or *b* and any of the alternating tail portions 20*a* or *b* are, with respect to each of the fairings 10 or 12, different in absolute terms; but the aspect ratios of their respective cross-sections are, in any event, similar. In general, as noted above, the aspect ratios may vary from about 1.8:1 to about 4:1, and most usually are in the range of 2:1 to 2.1:1.

It can also be seen that, depending upon the absolute dimensions of width and chord lengths, the aspect ratio of any of the upstanding rib portions may be greater or less than that of the intervening tail portions; but in general, the aspect ratio of any cross-section taken through any of the upstanding rib portions is at least equal to and is usually greater than the aspect ratio of any cross-section taken through any of the alternating tail portions of fairings contemplated by this invention.

Figure 6:
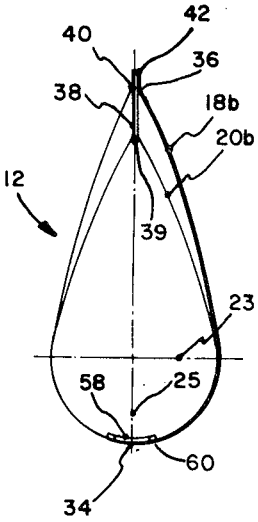
FIG. 6 is a view similar to FIG. 5 of the fairing of FIG. 2.
Figure 7:
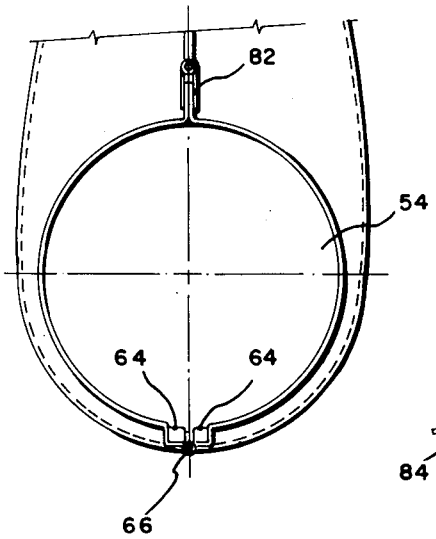
FIGS. 7 and 8 are partial cross-sections showing the hinge and latch portions of the fairing assembly of FIG. 1.

Referring now to fairing 12 illustrated in FIGS. 2 and 6, it will be seen that there is a trailing fin portion of substantially cross-section which extends rearwardly from each of the upstanding rib portions 18*b* and the alternating tail portions 20*b*. The trailing fin portion extending rearwardly from behind any of the alternating tail portions 20*b* is designated generally at 38, and the trailing fin portion extending behind any of the rib portions 18*b* is designated generally at 40. Each of these trailing fin portions 38 and 40 are shown in FIG. 6. It is seen that the trailing edge 42 of the fairing 12 is further behind the front 44 of the fairing 12 than the rearmost point at which the cross-section taken through any of the rib portions 18*b*—point 36—or the cross-section taken through any of the alternating tail portions 20*b*—point 39—is determined as the rearmost point of each respective cross-section where the rearward taper thereof terminates.

Likewise, referring to fairing 10 in FIGS. 1 and 5, it will be noted that there is a trailing fin portion 46 which is rearward of the alternating tail portions 20*a*, but that the upstanding rib portions 18*a* extend to the trailing edge 48 of the fairing 10. In this embodiment, therefore, the trailing fin portion 46 of the fairing extends rearwardly of its respective alternating tail portion 20*a* to substantially the same distance behind the front 50 of the fairing as the upstanding rib portions 18*a* extend.

Figure 4:
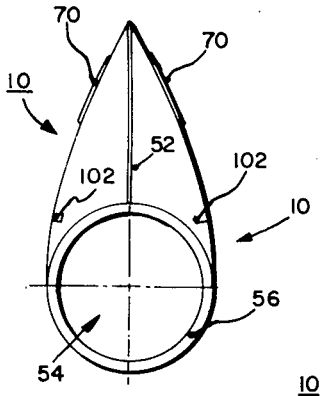

It will be noted in FIGS. 5 and 6 that the fairings 10 and 12 are, indeed, formed as shells; and that the pipe or pipe bundle which is being faired by the fairings is accommodated within the shell. So as to provide that accommodation, the fairings are substantially closed at each end thereof in the tail portion 17, by a flange 52 in fairing 10 or 54 in fairing 12. It will be seen from the end view in FIG. 4 of fairing 10 that the end of the fairing is also formed with a hole 54 having a rim 56, so as to accommodate in one way or another as discussed hereafter a pipe which is to be faired.

A fairing 10 or 12 may be fitted to a pipe 16 or a pipe bundle 14 in several different manners. Where the pipe 16 is substantially the same size as the opening or hole in the ends of the nose portion of the fairing, it may be necessary merely to fit the shell to the pipe. Where the pipe is smaller than the axial holes in the nose portions of the fairing, or where a pipe bundle 14 is to be fitted, a collar is generally used in the manner described hereafter. In any event, in order to rapidly and easily fit the fairing to the pipe, the shell halves—which are obviously substantially identical because of the symmetry of the fairing—are fitted around the pipe so as to accommodate it in the nose portion of the fairing in an appropriate manner. In general, the shell halves have a hinge formed between them at the parting line in the nose portion thereof, and are secured in their trailing edges and/or elsewhere by removable fasteners of one form or another. Thus, for example, the fairing 12 of FIGS. 2 and 6 has a hinge plate 58 secured to each of the shell halves by fasteners such as 60, where the hinge plate itself is flexible. Removable fasteners 62 are placed near the trailing edges of the shell halves, and may be such as removable pop rivets, threadable fasteners or the like. It can be seen that the shell halves of the fairing 12 can be opened merely by flexing the hinge plate 58 in the nose portion thereof so as to fit the fairing to the pipe 16; and thereafter the removable fasteners 62 are put in place to secure the shell halves together at or near the trailing edges thereof. Fasteners may also be passed through the upstanding flanges 54 at the ends of the fairing.

The hinge arrangement in the nose of the fairing 10 may be somewhat more complicated than merely a flexible plate. In this case, a hinge arrangement is provided, which comprises a pair of tubes 64—which may have a square cross-section—having a hinge such as a piano-type hinge 66 welded or secured to the tubes so as to provide a hinging arrangement therebetween. The tubes 64 are, in turn, secured by fasteners 68 to the shell halves of the fairing, so that the shell halves are therefore hinged together by a hinge placed at the parting line thereof in the nose of the fairing. The fastening arrangement in the tail portions and in the end flange portions of the fairing 10 is described hereafter. In any event, it can be seen that the shell halves can be easily handled and fitted to a pipe or pipe bundle because of the hinging arrangement between the shell halves in the nose portion thereof.

Referring now to fairing 10, it is noted that the fairing has a pair of stabilizer plates 70 secured across the outer portions of the ribs 18*a* of the fairing, on either side thereof. The pair of stabilizer plates 20 extends at least between two adjacent upstanding rib portions 18*a* near the rearward end of each of the upstanding rib portions 18*a;* and in general, the stabilizer plates 70 extend from the endmost upstanding rib portion at one end of the fairing to the endmost upstanding rib portion at the other end of the fairing across the outer surfaces of the rib portions. The fairings are secured thereto by suitable fasteners such as nylon rivets when the fairing comprises plastic shell halves. The stabilizer plates may appear to some extent to form an analogy of the fairing to a slotted wing; but the symmetry of the fairing in view of its necessity to restore itself to the axis of flow in either direction is significantly different than a slotted wing per se. However, the cross-section of the stabilizer plate 70 may, itself be tapered from the forward edge thereof to the trailing edge thereof, with a rounded or streamlined forward edge so as to reduce drag. The stabilizer plates 70 may, of course, be placed on the fairing 12 in a similar manner as shown with respect to fairing 10.

In general, the stabilizer plates 70 overlie the rearmost ends of the alternating tail portions 20*a* (or 20*b*) and therefore also overlie the rearmost portions of the alternating tail portions and the foremost portions of each of the respective trailing fin portions 38 or 46 formed behind the alternating tail portions of the fairing.

Figure 9:
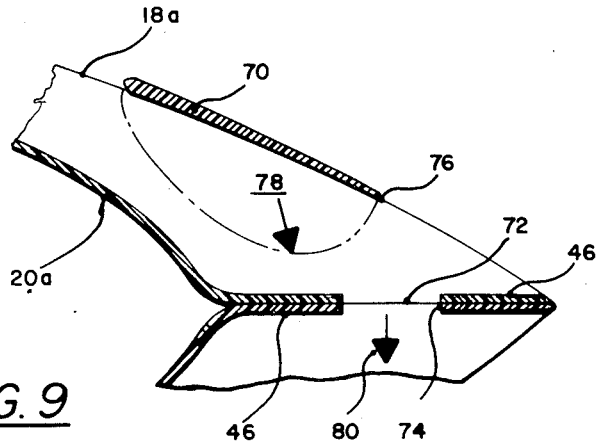
FIG. 9 is a partial cross-section of the trailing end of the fairing of FIG. 1 showing an hypothesis as to the effect of restoring forces acting on the fairing.

In general, however, at least one aperture 72 is formed through each of the trailing fin portions 46 (or 38) over which the stabilizer plates 70 overlie. In a specific embodiment of the fairing 10, one aperture 72 is formed in each of the trailing fin portions 46 over which the stabilizer plates 70 overlie, and the rearmost edge 74 of each of the apertures 72 is rearward of the rearmost edges of the stabilizer plates 70; that is, the rearmost edges 74 of the aperture 72 are further from the front of the fairing than the rearmost edges 76 of the stabilizer plates 70.

Where there are stabilizer plates 70 fitted to the fairing, and aperture 72 formed through the trailing fin portions behind the alternating tail portions of the fairing and beneath the trailing edges of the stabilizer plates, an hypothesis can be postulated as to the additional restoring forces acting upon the fairing, notwithstanding the very low aspect ratio thereof. Referring to FIG. 9, it is noted that a pressure envelope 78 develops beneath the stabilizer plate 70 in the enclosed volume between it and the alternating tail portion 28 and trailing fin portion 46 of the fairing. It is noted that the net effect of the pressure envelope 78 is such as to direct the concomitant forces of the pressure envelope towards the front-to-back axis of the fairing. Thus, when the angle of attack of the relative flow of the fairing to the fluid medium, say water, in which it is immersed changes, there is a net restoring force formed by the pressure envelope 78 on the side of the fairing into which the relative flow of the fairing to pressure medium has turned, thereby forcing the trailing edge of the fairing away from the pressure envelope so as to re-align the axis of the fairing with stream flow. Likewise, where there is an aperture 72 through the trailing fin portion 46 of the fairing, there may be a net flow of the fluid medium through the aperture, with a concomitant restoring force in the opposite direction to the flow, as shown by arrow 80 in FIG. 9. Thus, the fairing tends to accommodate itself or to re-align itself with the relative stream flow, notwithstanding the short aspect ratio; and the net coefficient of drag on the fairing and the pipe which is faired thereby, is reduced.

Referring briefly to other structural features of fairings contemplated by the present invention, it may be noted that the upstanding rib portions 18*a* of the fairing 10 extend forwardly of the tail portion 17 thereof to enwrap at least a part of the nose portion 15 of the fairing. The upstanding rib portions 18*b* of the fairing 12 substantially terminate near the cross-axis of the nose portion of the fairing; although additional rib portions may be formed in the forward parts of the nose portion of each shell half of the fairing. The rib portions extending through or into the nose portion of the fairing tend to stiffen the fairing shell half for easier handling thereof, and as well provide for greater control of the aspect ratio of the cross-section of the fairing taken through the rib portion thereof.

Figure 3:
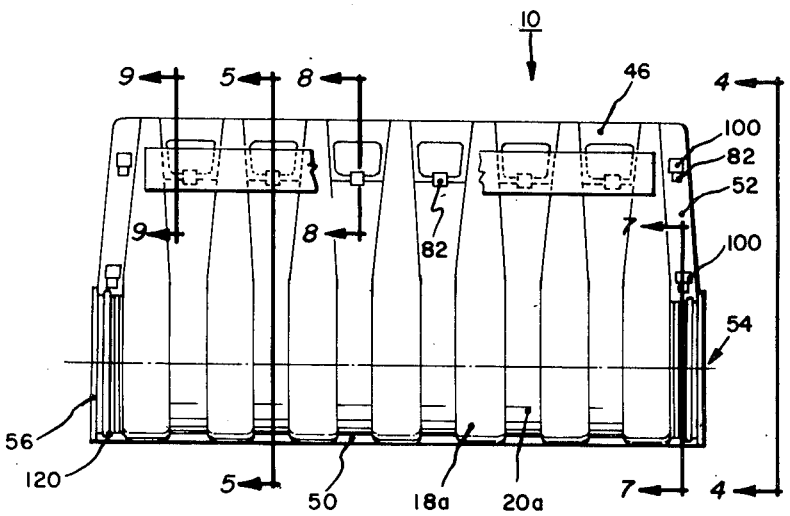
FIGS. 3, 4 and 5 are side, end and cross-sectional views, respectively, of the fairing of FIG. 1.

Likewise, the axial length of each of the upstanding rib portions, in the forward end thereof, may or may not be equal to the axial length of the intervening or alternating tail portions in the forward portions of each thereof. In general, the forward portions of the upstanding rib portions are slightly longer in their axial length—relative to the axis of the nose portion of the fairing—with respect to the axial length of the alternating tail portions in their forward portions thereof, although the relationship of the axial length of the upstanding rib portions of the alternating tail portions in the forward parts thereof may range from about 0.5:1 to about 1.5:1. The rearward portions of the upstanding rib portions may taper when viewed from the side as in FIG. 3, so that the axial length of each of the rib portions 18*a*, decreases as the distance away from the front of the fairing increases. The upstanding rib portions may taper from front-to-back, or the taper may begin at some intermediate point as shown in FIG. 3.

Figure 8:
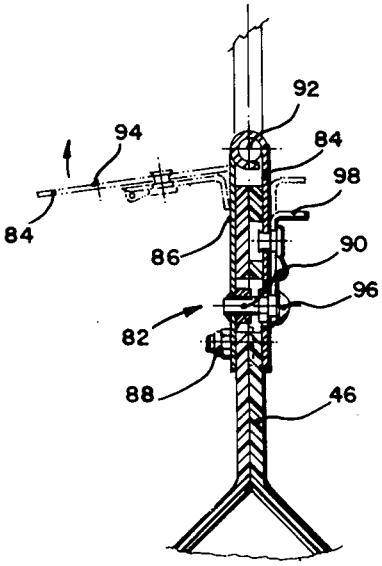

To accommodate the fastening arrangement between the shell halves of the fairing 10, a two-plate hinged fastener is provided, and is indicated generally by the reference numeral 82. Referring to FIG. 8, the two-plate hinged fastener 82 is seen to comprise plates 84 and 86, and is secured to the mated shell half parts of the trailing fin portion 46 (or end flange 52) as discussed hereafter—by fasteners 88. It will be seen that a pin 90 is secured to the plate 86, and the plate 84 is swung around pin 92 so that an aperture 94 therein passes over the head 96 of the pin 90. Thereafter, a pin capturing means 98 such as a slidable latch captures the head 96 of pin 90 so as to preclude any further swinging motion of the plate 84 with respect to the plate 86, and thereby so as to securely fasten the two shell halves together at each to plate hinged fastener 82.

It will be noted that a pair of apertures 100 may be formed in the end flanges 52 of the fairing 10, and similar to plate hinged fasteners 82 employed in each of the flange apertures 100. It is thus seen that the fairing 10 may be easily assembled or dis-assembled without the necessity for special tools or handling apparatus. However, so as to accommodate the large size of the fairing, lifting lugs 102 may be provided at each end thereof.

Figure 11:
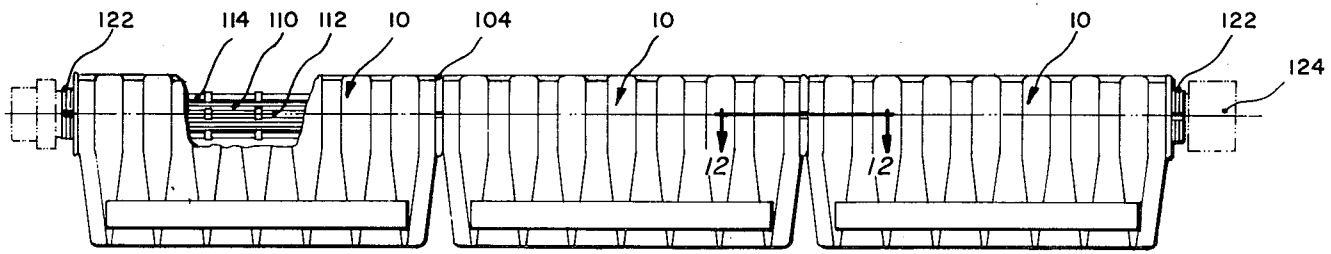
FIG. 11 is a side view of a fairing assembly to a pipe, where part of one fairing is broken away.
Figure 12:
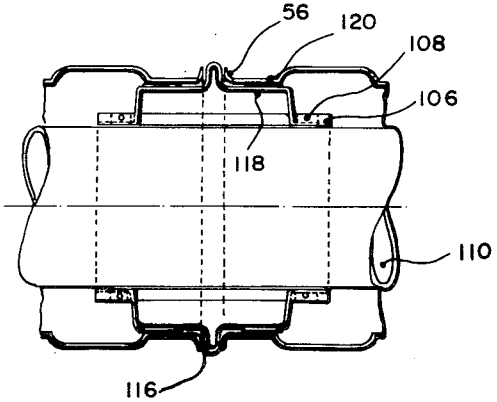
FIG. 12 is a cross-section of a collar according to this invention.
Figure 10:
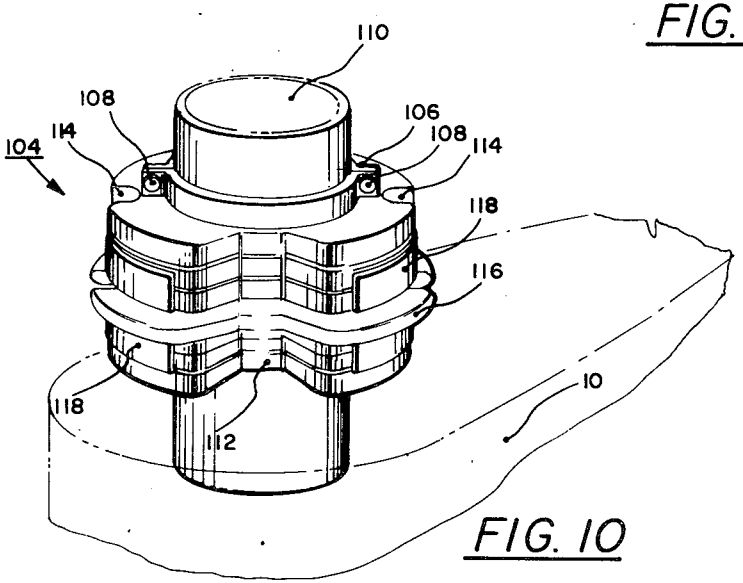
FIG. 10 is a perspective view of a collar used with fairings according to this invention.

In general, a collar assembly is provided so as to fit the fairing to the pipe or pipe bundle which is to be faired, and also so as to accommodate the swinging action or rotating motion of the fairing with respect to the pipe or pipe bundle. Referring to FIGS. 10, 11 and 12, one form of collar—of the sort which is used between individual fairings in a group of fairings assembled to a pipe length, is shown. The collar is designated generally by the reference numeral 104, and it may be formed in two halves which are joined together such as by a collar band 106 and fasteners 108 accommodated thereby. The collar 104 is shown in FIG. 10 to be secured to a pipe 110, also indicated in FIG. 1. A plurality of openings 112 and 114 may be provided around the collar to accommodate pipe bundles, choke lines, etc., such as indicated at 112 and 114 in FIG. 1. Obviously the collar 104 must fit the end opening 54 of the fairing; and any further pipes, choke lines etc. which are accommodated together with a pipe 110 in the opening 54 must have a dimension radially outwardly from the axis of the pipe 110 which is less than the difference of the radii of opening 54 and pipe 110.

A central bearing shoulder 116 is formed in the collar 104, and bearing pads 118 are placed around the collar 104. The ends of the fairing 10 are formed with ribs 120 near the rim 56, and it will be seen in FIG. 12 that the ribs 120 rub against the bearing pads 118 as the fairing 10 swings or rotates about the axis of the pipe 110. The friction between the bearing pads and the swinging ribs or mating bearing pads carried by the ribs is therefore very low so that the restoring force of stream flow acting against the tail portion of the fairing can cause the tail portion thereof to swing for re-alignment with the stream flow. Likewise, the net force against the pipe is reduced as a consequence of relative stream flow with respect thereto.

Collars 122 may be fitted in the axial opening at the end of each fairing bundle, as shown in FIG. 11. In this case, the collars 122 may comprise essentially half of a collar 104. Intermittent devices 124 such as booster pumps and the like may therefore be mounted along the length of the pipe, as required.

In general, the shell halves of fairings such as those shown in FIGS. 1 and 2 and as discussed above are formed from a plastics material such as acrylonitrile butadiene styrene. The shell halves may therefore be vacuum formed, and after being fastened to their respective nose hinge assemblies, they may be mounted to the pipes or pipe bundles for which they are intended. When the fairing is flooded after immersion in water, for example, the fairing may have substantially neutral buoyancy. However, it may be necessary to provide some additional buoyancy material such as buoyancy panels 126 shown in FIG. 5 in the tail portion of the fairing. In any event, in one practical embodiment of the fairing 10 where the overall width of the fairing nose portion is greater than 1 m. and the length of the fairing is approximately 6 m., the free weight of an assembled fairing in air is less than 150 kg.; and the weight in water of the fairing is substantially nil.

An additional axial opening 128 may be formed in the tail portion of the fairing so as to accommodate a cable or the like passed through the opening along the length of the fairing. That additional opening 128 is indicated in FIG. 2 as being formed in fairing 12 shown therein.

There has been described above a fairing for pipes or other substantially rigid structures. The other structures may be pipelines and the like, or they may be vertical pipes used in apparatus for mining manganese nodules from the sea bed, and the like. Fairings may also be fitted to the legs of drilling rigs as well as to the riser pipes thereof, so as to reduce the force of current flow against them.

It has been noted that a fairing according to this invention has two aspect ratios taken through the ribs and alternating tail portions respectively, where the aspect ratios are similar and are generally quite low. Likewise, the fairing may have stabilizer plates secured across the rib portions near the trailing ends thereof, and apertures may be formed through the thickness of trailing fins near the trailing edges of the fairing. The stabilizer plates may also be mounted on the fairing by being secured at the outer ends of struts whose bases are secured to the fairing, so that the undersides of the stabilizer plates are spaced away from the outer surfaces of the rib portions. The fairing is generally mounted to lengths of pipe by collars fitted at each end of the fairing; and where the fairings are formed as substantially identical shell halves of plastics material, they may be light enough in air as to be handled by one or two workers, without additional handling and assembly equipment or apparatus.

Other modifications and embodiments of fairings contemplated by this invention may be devised without departing from the spirit and scope of the appended claims.

The embodiments of the invention in which an exclusive property or privilege is claimed are defined as follows:

1. A fairing for pipes and other substantially rigid structures immersed in a fluid medium, for reducing the coefficient of drag on said pipe due to relative flow thereof with respect to said fluid medium, said fairing comprising a shell of substantially rigid material forming a symmetrical structure having a nose portion and a tail portion; where (a) said nose portion has an opening along its axis to accommodate said pipe; and (b) at least said tail portion has a plurality of upstanding rib portions spaced axially along each side of said fairing and extending rearwardly from the front of said fairing, and a plurality of alternating tail portions at least between said upstanding rib portions;

where aspect ratios taken at a cross-section through any of said upstanding rib portions and a cross-section through any of said alternating tail portions are similar; said aspect ratios being the ratio of length to breadth of the fairing, the breadth being the greatest width of each respective cross-section and the length of each respective cross-section being taken along the chord length thereof to the rearmost point of the cross-section where a rearward taper thereof terminates; the length and breadth, respectively, of any cross-section taken through any of said upstanding rib portions being different, in absolute terms, than the length and breadth respectively of any cross-section taken through any of said alternating tail portions of said fairing;

and where each of said alternating tail portions terminates at a trailing fin portion of said fairing which extends rearwardly of said respective alternating tail portion to substantially the same distance behind the front of said fairing as said upstanding rib portions extend.

2. The fairing of claim 1 where the aspect ratio of any cross-section taken through any of said upstanding rib portions is at least equal to the aspect ratio of any cross-section taken through any of said alternating tail portions.

3. The fairing of claim 1 where said upstanding rib portions of said fairing are extended forwardly of said tail portion to enwrap at least a part of said nose portion of said fairing.

4. The fairing of claim 1 where the axial length of each of said upstanding rib portions, in the forward portion of each, is 0.5 to 1.5 times the axial length of each of said alternating tail portions in the forward portion thereof.

5. The fairing of claim 4 where the axial length of each of said upstanding rib portions, in the rearward portion of each, decreases as the distance away from the front of the fairing increases.

6. The fairing of claim 1, further comprising a pair of stabilizer plates extending between at least two adjacent upstanding rib portions near the rearward end of each, on each side of said fairing.

7. The fairing of claim 6 where said stabilizer plates extend from the endmost upstanding rib portion of said fairing at one end thereof to the endmost upstanding rib portion at the other end thereof and across the outer surfaces of said rib portions.

8. The fairing of claim 7 where said stabilizer plates overlie the places where all of said alternating tail portions between said two endmost upstanding rib portions terminate, so as to overlie the rearmost portions of each of said alternating tail portions and the foremost portions of each of said trailing fin portions.

9. The fairing of claim 8 where at least one aperture is formed through each of said trailing fin portions over which said stabilizer plates overlie.

10. The fairing of claim 9 where the rearmost edge of each of said apertures is further from the front of said fairing than the rearmost edges of said stabilizer plates.

11. The fairing of claim 9 where said shell comprises a pair of substantially identical shell halves facing each other, and having a hinge formed between the shell halves at the parting line in the nose portion thereof; and where one plate of a two-plate hinged fastener is secured to one shell half at the leading edge of each of said apertures in said trailing fin portions, and at least one pin means is secured to one of said plates and passes through said respective trailing fin portion where it may be captured by pin capturing means secured to the other of said plates.

12. The fairing of claim 11 where said shell halves are closed at each end except for the axial opening in the nose portion, and form axially extending flanges; where at least one aperture is formed through the flange at each end of said fairing and a two-plate hinged fastener is secured to one of said shell halves at each of said apertures in said flanges.

13. The fairing of claim 1, further comprising a collar fitted in the axial opening of said nose portion at at least one end of said fairing and adapted to accommodate a pipe in a central opening of said collar, where said pipe has an overall diameter less than that of said axial opening in the nose portion of said fairing.

14. The fairing of claim 13 where said collar has at least one further opening through its thickness adapted to accommodate the passage therethrough of a further pipe or the like having a dimension radially outwardly from the axis of the pipe accommodated in the central opening which is less than the difference of radii of said central opening of said collar and said axial opening in the nose portion of said fairing.

15. The fairing of claim 1 where said shell comprises a pair of substantially identical shell halves facing each other, and having a hinge formed between the shell halves at the parting line in the nose portion thereof.

16. The fairing of claim 15 where said shell halves are secured at the trailing edges thereof by removable fasteners accommodated thereby.

17. The fairing of claim 15 where the material of said shell halves is acrylonitrile butadiene styrene.

18. The fairing of claim 1, where the material of said shell is a plastic material.

19. The fairing of claim 18, further comprising sufficient buoyancy material installed in the tail portion of said shell so as to give the fairing substantially neutral buoyancy in water.

20. The fairing of claim 1, further comprising a second axial opening formed in the tail portion of said fairing to accommodate a cable or the like passed therethrough along the length of said fairing.

21. An assembly of fairings according to claim 1, with the nose portions thereof axially aligned and a collar mounted between each adjacent pair of fairings at the axial openings of said nose portions thereof.

22. The combination of claim 21, further comprising a pair of collars mounted at the endmost axial openings of the nose portions of the endmost fairings of said assembly.

23. The fairing of claim 1 where the fluidynamic aspect ratio of a cross-section thereof taken through any of said upstanding rib portions is approximately 2.1:1 and the fluidynamic aspect ratio of a cross-section thereof taken through any of said alternating tail portions is approximately 2:1.

24. A fairing for pipes and other substantially rigid structures immersed in a fluid medium, for reducing the coefficient of drag on said pipe due to relative flow thereof with respect to said fluid medium, said fairing comprising a shell of substantially rigid material forming a symmetrical structure having a nose portion and a tail portion; where (a) said nose portion has an opening along its axis to accommodate said pipe; and (b) at least said tail portion has a plurality of upstanding rib portions spaced axially along each side of said fairing and extending rearwardly from the front of said fairing, and a plurality of alternating tail portions at least between said upstanding rib portions;

where aspect ratios taken at a cross-section through any of said upstanding rib portions and a cross-section through any of said alternating tail portions are similar; said aspect ratios being the ratio of length to breadth of the fairing, the breadth being the greatest width of each respective cross-section and the length of each respective cross-section being taken along the chord length thereof to the rearmost point of the cross-section where a rearward taper thereof terminates; the length and breadth, respectively, of any cross-section taken through any of said upstanding rib portions being different, in absolute terms, than the length and breadth respectively of any cross-section taken through any of said alternating tail portions of said fairing;

and where said alternating tail portions and said upstanding rib portions terminate at a trailing fin portion of said fairing which extends rearwardly therefrom.

25. The fairing of claim 24, further comprising a pair of stabilizer plates extending between at least two adjacent upstanding rib portions near the rearward end of each, on each side of said fairing.

26. A fairing for pipes and other substantially rigid structures immersed in a fluid medium, for reducing the coefficient of drag on said pipe due to relative flow thereof with respect to said fluid medium, said fairing comprising a shell of substantially rigid material forming a symmetrical structure having a nose portion and a tail portion; where (a) said nose portion has an opening along its axis to accommodate said pipe; and (b) at least said tail portion has a plurality of upstanding rib portions spaced axially along each side of said fairing and extending rearwardly from the front of said fairing, and a plurality of alternating tail portions at least between said upstanding rib portions;

where aspect ratios taken at a cross-section through any of said upstanding rib portions and a cross-section through any of said aternating tail portions are similar; said aspect ratios being the ratio of length to breadth of the fairing, the breadth being the greatest width of each respective cross-section and the length of each respective cross-section being taken along the chord length thereof to the rearmost point of the cross-section where a rearward taper thereof terminates; the length and breadth, respectively, of any cross-section taken through any of said upstanding rib portions being different, in absolute terms, than the length and breadth respectively of any cross-section taken through any of said alternating tail portions of said fairing;

and where each of said aternating tail portions terminates at a trailing fin portion of said fairing which extends rearwardly of said respective alternating tail portion to substantially the same distance behind the front of said as said upstanding rib portions extend;

and further comprising a pair of stabilizer plates extending between at least two adjacent upstanding rib portions near the rearward end of each, on each side of said fairing.

* * * * *